US006006381A

United States Patent [19]

Tandrup

[11] Patent Number: 6,006,381

[45] Date of Patent: Dec. 28, 1999

[54] SUPPORT PILLOW

[76] Inventor: Laurie Lynne Tandrup, P.O. Box 875, Onoway, Alberta, Canada, T0E 1V0

[21] Appl. No.: 09/115,501

[22] Filed: Jul. 15, 1998

[51] Int. Cl.[6] ..... A47C 20/02

[52] U.S. Cl. ..... 5/655; 5/637

[58] Field of Search ..... 5/622, 636, 637, 5/655

[56] References Cited

U.S. PATENT DOCUMENTS

| | | | |
|---|---|---|---|
| D. 159,483 | 8/1950 | Glassman | 5/636 X |
| D. 254,891 | 5/1980 | Mills . | |
| D. 348,174 | 6/1994 | Genis . | |
| 673,872 | 5/1901 | Hillern-Flinsch . | |
| 1,385,355 | 7/1921 | Banks . | |
| 1,861,668 | 6/1932 | Tenney . | |
| 2,336,707 | 12/1943 | Thompson . | |
| 2,765,480 | 10/1956 | Mueller . | |
| 2,877,472 | 3/1959 | Wagner | 5/636 |
| 2,952,856 | 9/1960 | Ruff . | |
| 3,327,330 | 6/1967 | McCullough | 5/636 X |
| 3,667,074 | 6/1972 | Emery . | |
| 4,031,578 | 6/1977 | Sweeney et al. . | |
| 4,091,481 | 5/1978 | Redman . | |
| 4,197,604 | 4/1980 | Nakamura . | |
| 4,218,792 | 8/1980 | Kogan . | |
| 4,550,458 | 11/1985 | Fiore | 5/637 |
| 4,617,691 | 10/1986 | Monti et al. . | |
| 4,726,085 | 2/1988 | Antonio . | |
| 4,738,488 | 4/1988 | Camelio . | |
| 4,759,089 | 7/1988 | Fox . | |
| 4,783,866 | 11/1988 | Simmons et al. . | |
| 4,829,613 | 5/1989 | Yon . | |
| 4,850,068 | 7/1989 | Walpin et al. . | |
| 4,968,279 | 11/1990 | Smith . | |
| 5,026,315 | 6/1991 | Chap . | |
| 5,027,457 | 7/1991 | Sweet . | |
| 5,129,705 | 7/1992 | Wray . | |
| 5,216,772 | 6/1993 | Clute . | |
| 5,437,070 | 8/1995 | Rempp . | |
| 5,509,157 | 4/1996 | Story . | |
| 5,596,780 | 1/1997 | Brenn . | |
| 5,682,632 | 11/1997 | Controneo . | |

*Primary Examiner*—Terry Lee Melius
*Assistant Examiner*—James M Hewitt
*Attorney, Agent, or Firm*—Terry M Gernstein

[57] ABSTRACT

A support pillow includes a body with a central section and two wing sections pivotally attached to opposed sides of the central section. The preferred embodiment resembles the shape of a butterfly.

11 Claims, 7 Drawing Sheets

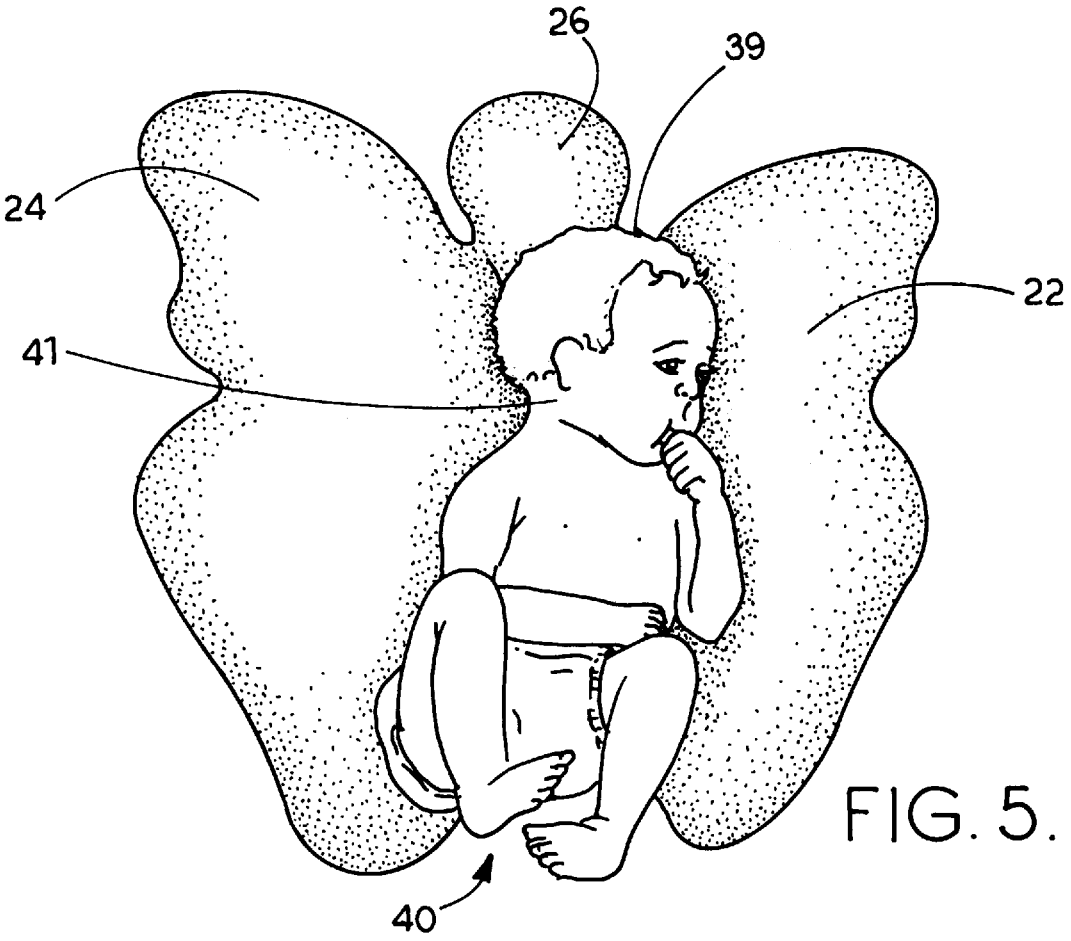
FIG. 5.
FIG. 6.
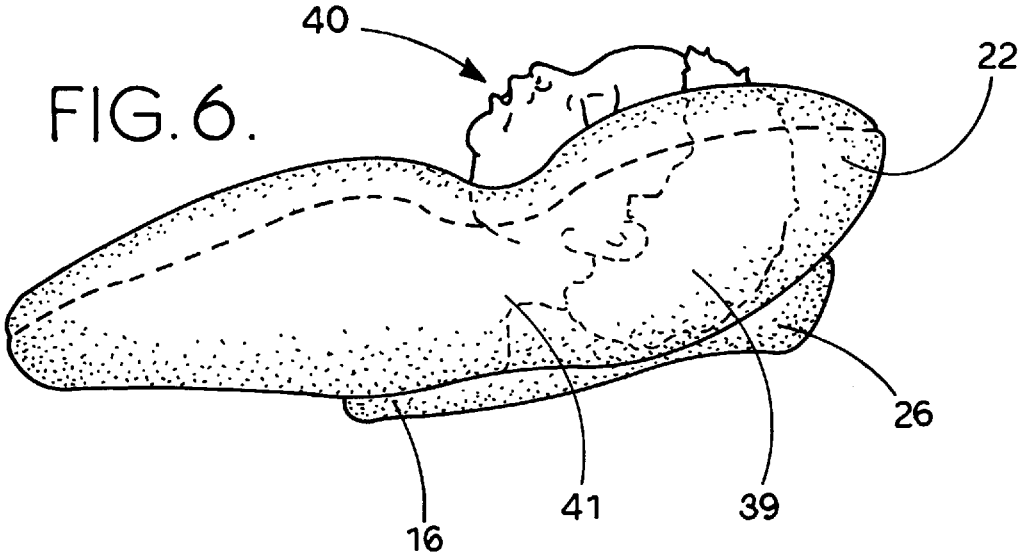

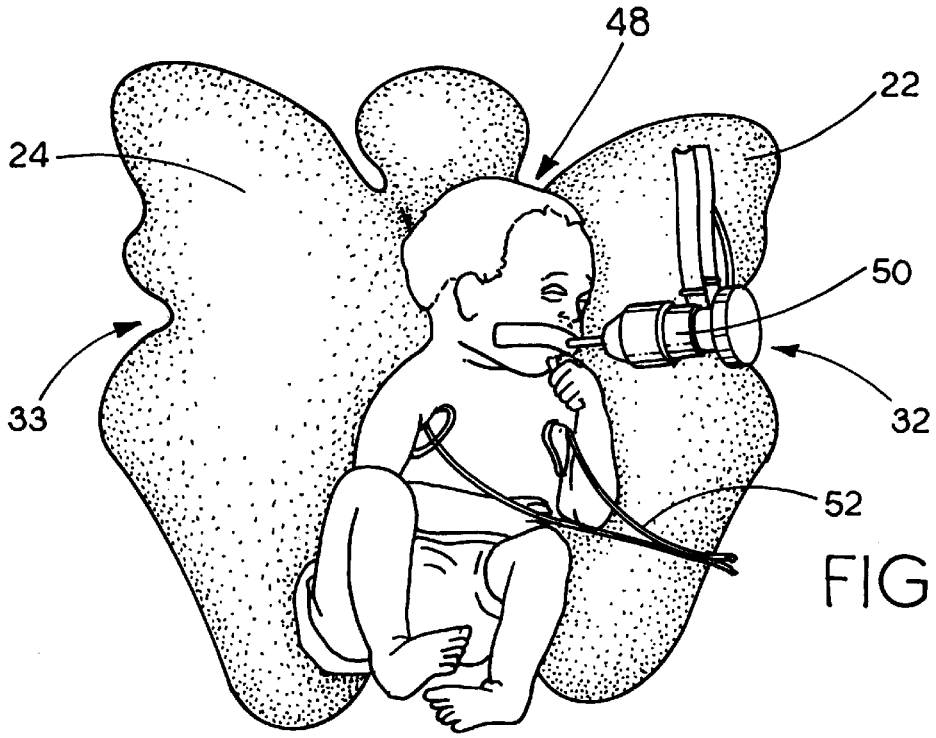
FIG.11.
FIG.12.
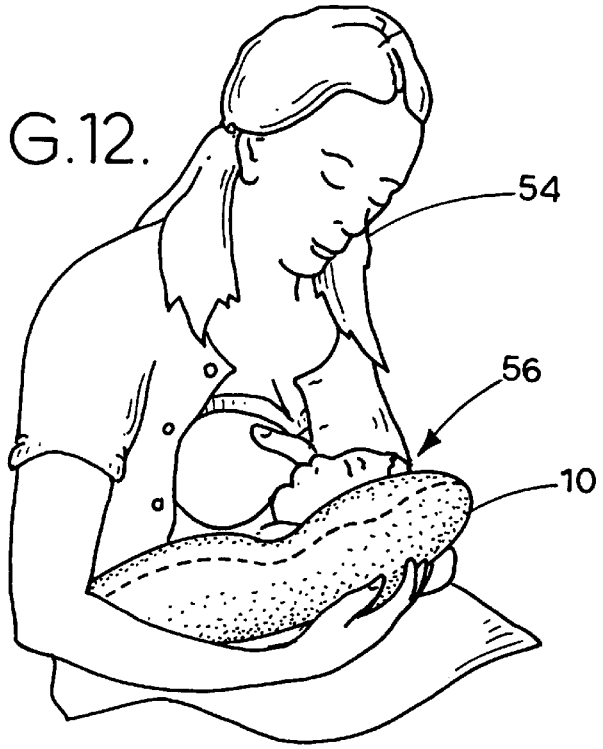

SUPPORT PILLOW

FIELD OF THE INVENTION

The present invention relates to a support pillow and, in particular, a support pillow suitable for use by children and premature infants.

BACKGROUND OF THE INVENTION

The proper support of a person's head, neck and upper body is important. Some persons, by virtue of pre-existing conditions, are susceptible to head, neck and upper body injuries. There are a variety of support pillows available for adults who are experiencing head and neck problems, but relatively few devices available that are also suitable for use with children. There are even fewer support pillows suitable for use with premature infants.

A particular problem has been identified relating to premature infants. The head and neck of a premature infant are extremely fragile and muscle tone is very low. Prolonged positioning in one position, without proper support, can lead to injury. There are a number of ailments experienced by premature infants that can be attributed to positioning. If care is not taken by nursing staff right side head preference can be reinforced during a long stay in a neonatal intensive care unit of a hospital. Positional Muscular Torticollis occurs when an infant experiences a strong lateral pull with rotation toward an affected side. Positional Plagiocephaly is a flattening of one side of the skull due to persistent pressure.

There are other ailments experienced by infants which, while not attributable to positioning, have symptoms which can be alleviated through the use of a support pillow. One example is head and neck hyperextension which is often seen in infants with Bronchopulmonary Dysplasia. Another example is Asymmetrical Tonic Neck Reflex in neurologically impaired babies. Another example is low muscle tone and the infant's inability to maintain midline centering.

A number of support pillows or positioning aids are currently used with premature infants. One support pillow used is a wedge shaped pillow sold under the trademark WEDGIE. The WEDGIE is used for partial rotation of the infant's head, and is commonly used to assist in positioning ventilator equipment. Another support pillow used is a horse shoe shaped pillow sold under the trademark SNUGGLE UP. The infant is placed in the horse shoe in the prone position with his or her head extending from an open top end. Flexible straps extend over the infant. A positioning aid used is a bendable frame sold under the trademark BENDY BUMPER. The BENDY BUMPER is bent around the infant to maintain the infant in a side lying position.

SUMMARY OF THE INVENTION

What is required is an alternative form of support pillow that is suitable for use in positioning premature infants.

According to the present invention there is provided a support pillow which includes a body with a central section and two wing sections pivotally attached to opposed sides of the central section.

The support pillow, as described above, provides a variety of supporting positions. In addition to being supported in a prone position, a baby can be supported on a left side, a right side or in a supine position, as will hereinafter be further described.

Although beneficial results may be obtained through the use of the support pillow, as described above, it is desirable to have the head of the infant elevated. Even more desirable results may, therefore, be obtained when the body has a first end and a second end, and the central section is generally circular in cross section and decreases circumference from the first end to the second end.

Although beneficial results may be obtained through the use of the support pillow, as described above, it is sometimes desirable to further elevate the infant's head. Even more beneficial result may, therefore, be obtained when the central section has a flexible protruding portion at a first end of the body that is unattached to the wing sections. When it is desirable to raise the infant's head, the flexible protruding portion can be folded under in order to do so.

Although beneficial results may be obtained through the use of the support pillow, as described above, there are tubes and ventilator equipment which must be accommodated. Even more beneficial results may, therefore, be obtained when the wing sections have outer peripheral edges with at least one indentation.

Although beneficial results may be obtained through the use of the support pillow, as described above, the needs of adults and older children differ from those of premature infants. Even more beneficial results may, therefore, be obtained when the two wing sections extend past the central section at a second end of the body to form a generally "U" shaped channel. The extended wings assist in the positioning of a torso of a premature infant and allows monitor cables to be laid over the wing sections. The "U" shaped channel accommodates a neck of an adult or older child to enable them to receive beneficial support from the support pillow.

Although beneficial results may be obtained through the use of the support pillow, as described above, it has been determined that even more beneficial results may be obtained when the body resembles that of a butterfly. A number of the above described features are inherent in the shape of a butterfly.

BRIEF DESCRIPTION OF THE DRAWINGS

These and other features of the invention will become more apparent from the following description in which reference is made to the appended drawings, wherein:

FIG. 5 is a top plan view of the pillow support illustrated in FIG. 1, supporting a premature infant.

FIG. 6 is a side elevation view of the pillow support illustrated in FIG. 1, supporting a premature infant.

FIG. 11 is a top plan view of the pillow support illustrated in FIG. 1, supporting a premature infant.

FIG. 12 is a side elevation view of the pillow support illustrated in FIG. 1, supporting a premature infant.

DETAILED DESCRIPTION OF THE PREFERRED EMBODIMENT

Figure 1:
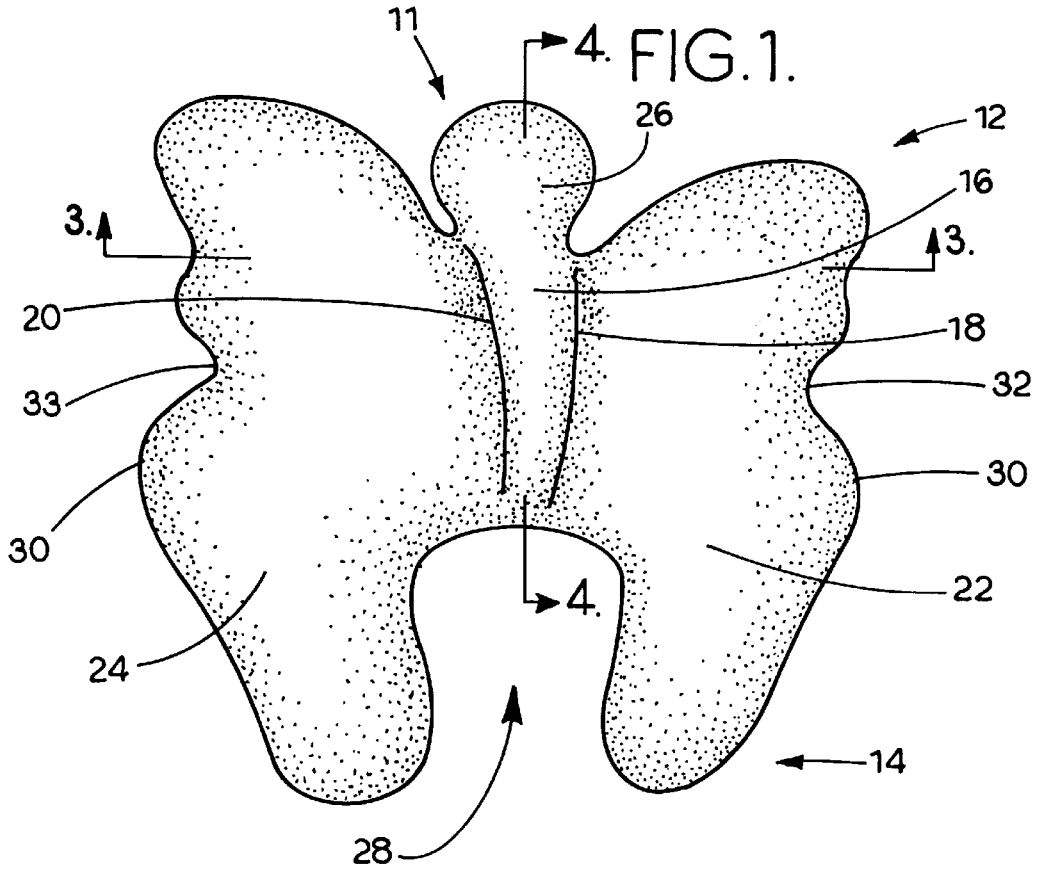
FIG. 1 is a top plan view of a support pillow constructed in accordance with the teachings of the present invention.

The preferred embodiment, a support pillow generally identified by reference numeral 10, will now be described with reference to FIGS. 1 through 13.

Referring to FIG. 1, support pillow 10 includes a body 11 resembling a butterfly, having a first end 12 and a second end 14. The central section 16 of the body 11 resembles a thorax and abdomen of a butterfly and has a first side 18 and a second side 20. A first wing section 22 resembles a wing of a butterfly pivotally secured to the first side 18 of the central section 16. Similarly a second wing section 24 resembling a wing of a butterfly is pivotally secured to the second side 20 of the central section 16. A flexible protruding portion 26 resembling an enlarged head of the butterfly extends from the central section 16 at the first end 12 of the body 11, the protruding portion 26 being unattached to the first wing section 22 and the second wing section 24. The first wing section 22 and the second wing section 24 extend past the central section 16 at the second end 14 of the body 11 to form a generally "U" shaped channel 28. The first wing section 22 and the second wing section 24 each have outer peripheral edges 30 with an first indentation 32 in first wing section 22 and a second indentation 33 in second wing section 24.

Figure 2:
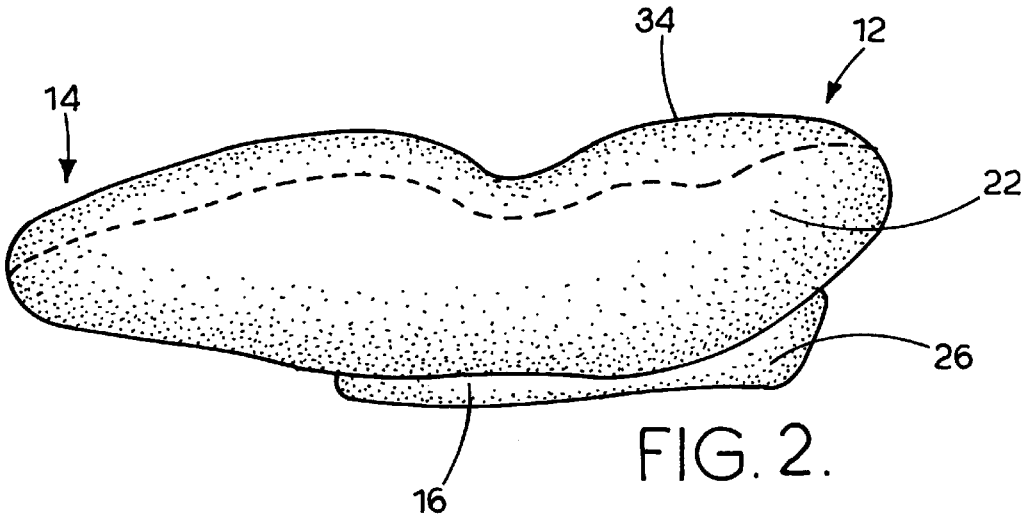
FIG. 2 is side elevation view of the support pillow illustrated in FIG. 1.
Figure 3:
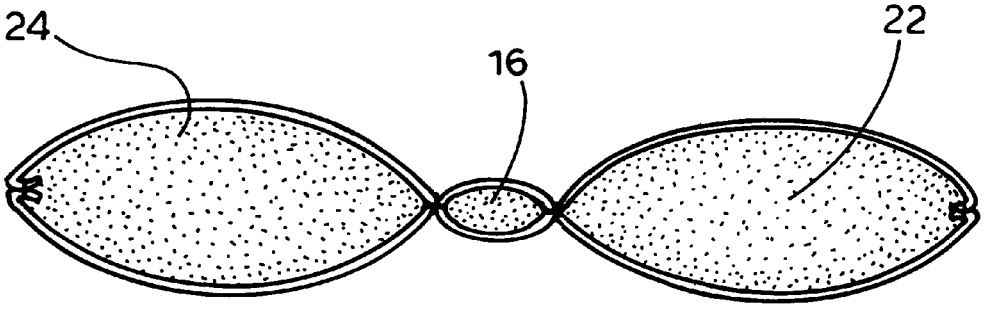
FIG. 3 is an end elevation view, in section, of the support pillow taken along section lines 3—3 of FIG. 1.
Figure 4:
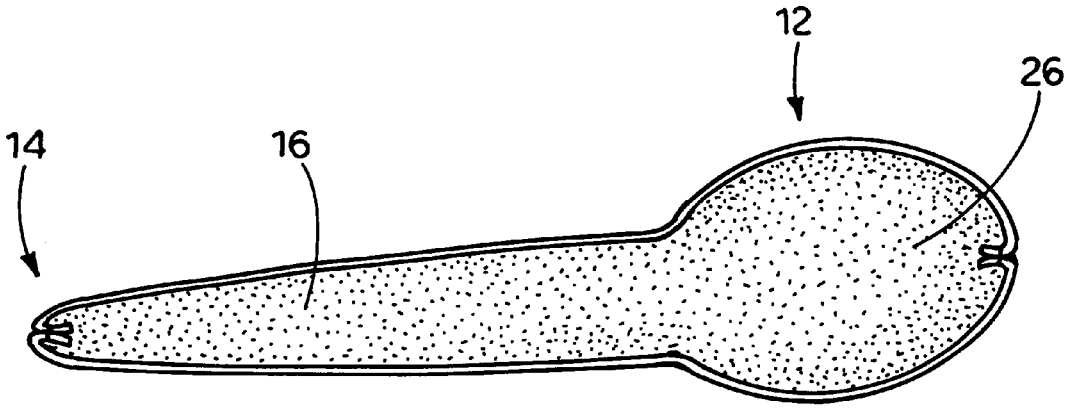
FIG. 4 is a side elevation view, in section, of a central section of the support pillow taken along section lines 4—4 of FIG. 1.

Referring to FIG. 2, first wing section 22 and second wing section 24 have more padding than central section 16 and are thicker than central section 16. Consequently the top surfaces 34 of first wing section 22 and second wing section 24 are elevated in comparison with central section 16 when pillow 10 is lain on a flat surface. The central section 16 of support pillow 10 is generally circular or oval as illustrated in FIG. 3, which shows a section of support pillow 10 taken along section lines 3—3 of FIG. 1. Preferably central section 16 decreases in width from the first end 12 to the second end 14 of the body 11 as illustrated in FIG. 4, which shows a section along section lines 4—4 of FIG. 1.

The potential uses of support pillow 10 will now be described with reference to FIGS. 1 through 13. Referring to FIGS. 5 and 6, a premature infant 40 or other small child can be maintained in a supine position using support pillow 10. The head 39 and neck 41 of the infant 40 are supported by central section 16 of the support pillow 10. Lateral or rolling movement of the infant 40 is prevented by first wing section 22 and the second wing section 24.

Figure 7:
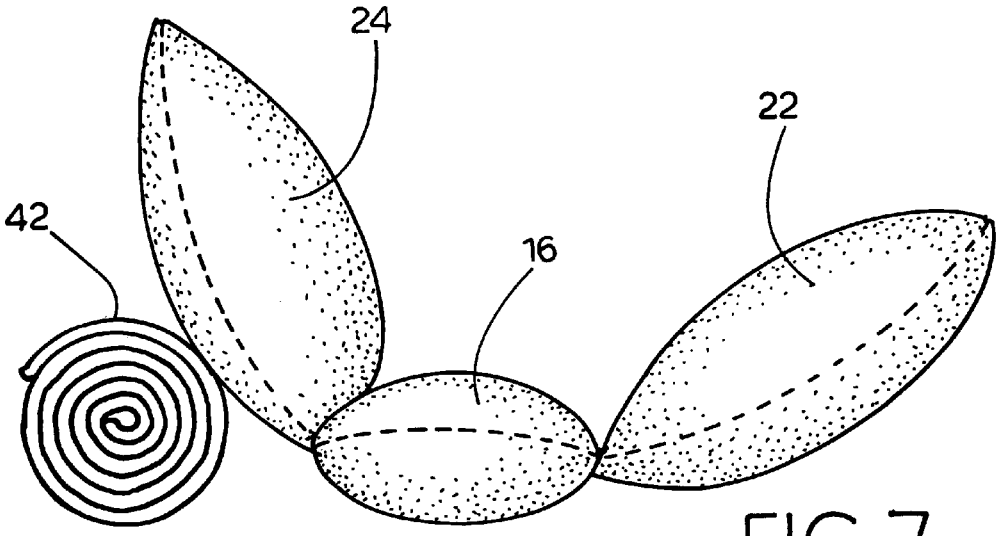
FIG. 7 is an end elevation view from a first end of the pillow support illustrated in FIG. 1.
Figure 8:
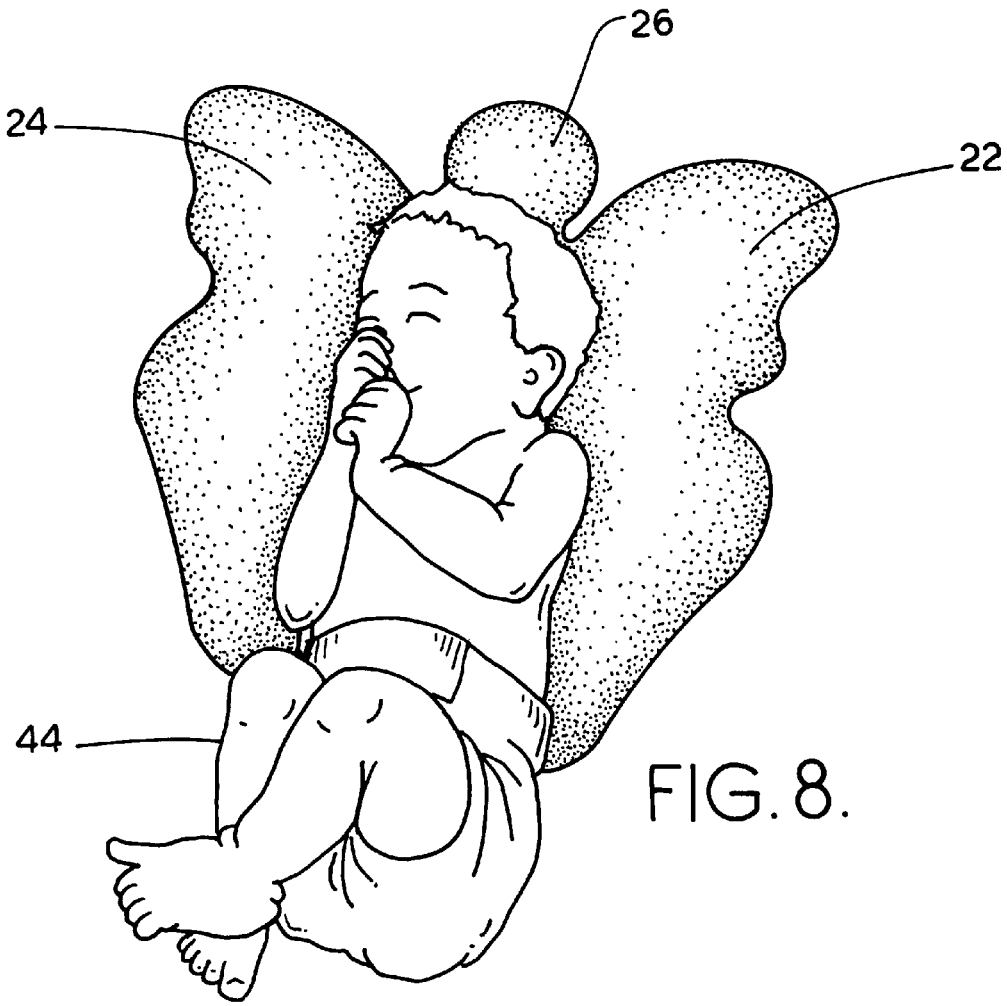
FIG. 8 is a side elevation view of the pillow support illustrated in FIG. 7, supporting a premature infant.

Referring to FIG. 7, one of either the first wing section 22 or the second wing section 24 may be pivotally elevated relative to other sections of support pillow 10 by means such as a rolled up towel or other cloth 42. When used in this manner support pillow 10 can be used to maintain an infant 44 in a lying position on one of either the left side or the right side of infant 44 as illustrated in FIG. 8.

Figure 9:
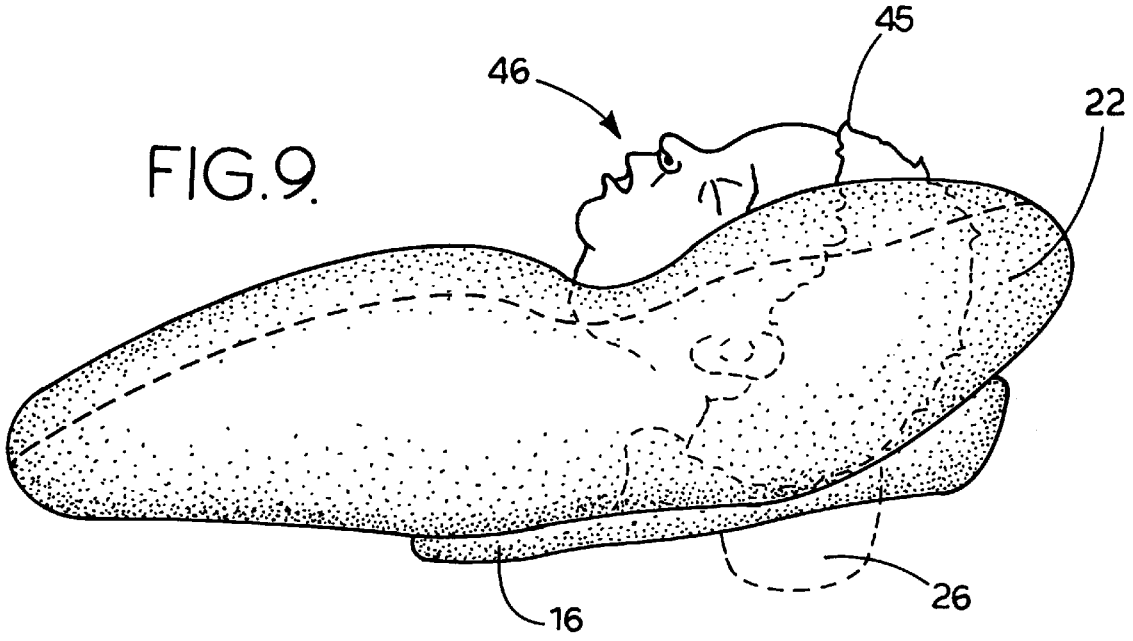
FIG. 9 is a side elevation view of the pillow support illustrated in FIG. 1, supporting a premature infant.
Figure 10:
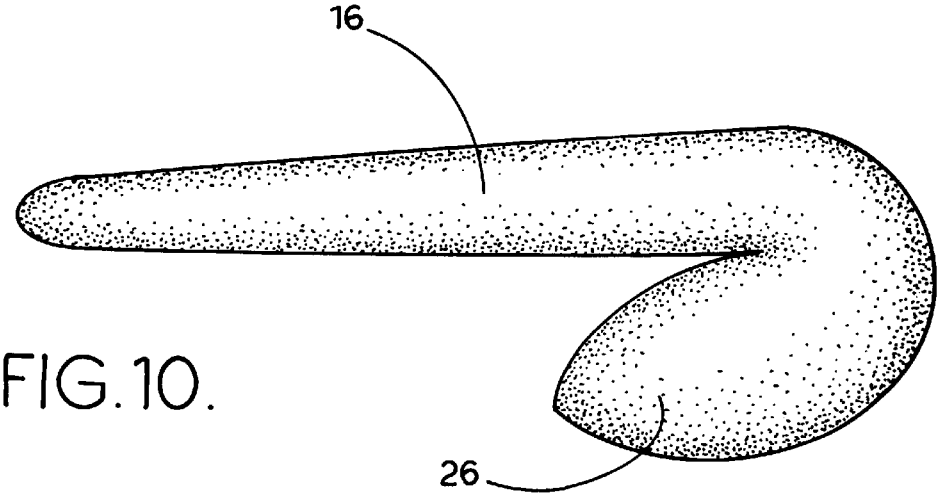
FIG. 10 is a side elevation view, in section, of a central section of the pillow support illustrated in FIG. 9.

Referring to FIG. 10, the protruding portion 26 of the body 11 of support pillow 10 may be bent under the central section 16 of body 11. When in this configuration the support pillow 10 can be used support the head 45 of an infant 46 in a more elevated position as illustrated in FIG. 9.

With reference to FIG. 11, an infant 48 to whom is connected medical equipment such as a ventilator 50 and monitoring equipment 52 can be supported using support pillow 10. When the infant 48 is lying on its left side the ventilator 50 is maintained in position using the first indentation 32 in the first wing section 22 of the support pillow 10. Similarly when the infant is lying on its right side the ventilator is maintained in position using second indentation 33 in the second wing section 24.

Referring to FIG. 12, support pillow 10 can be used by a mother 54 or other adult to support an infant 56 during breast feeding, bathing or other nurturing activities.

Figure 13:
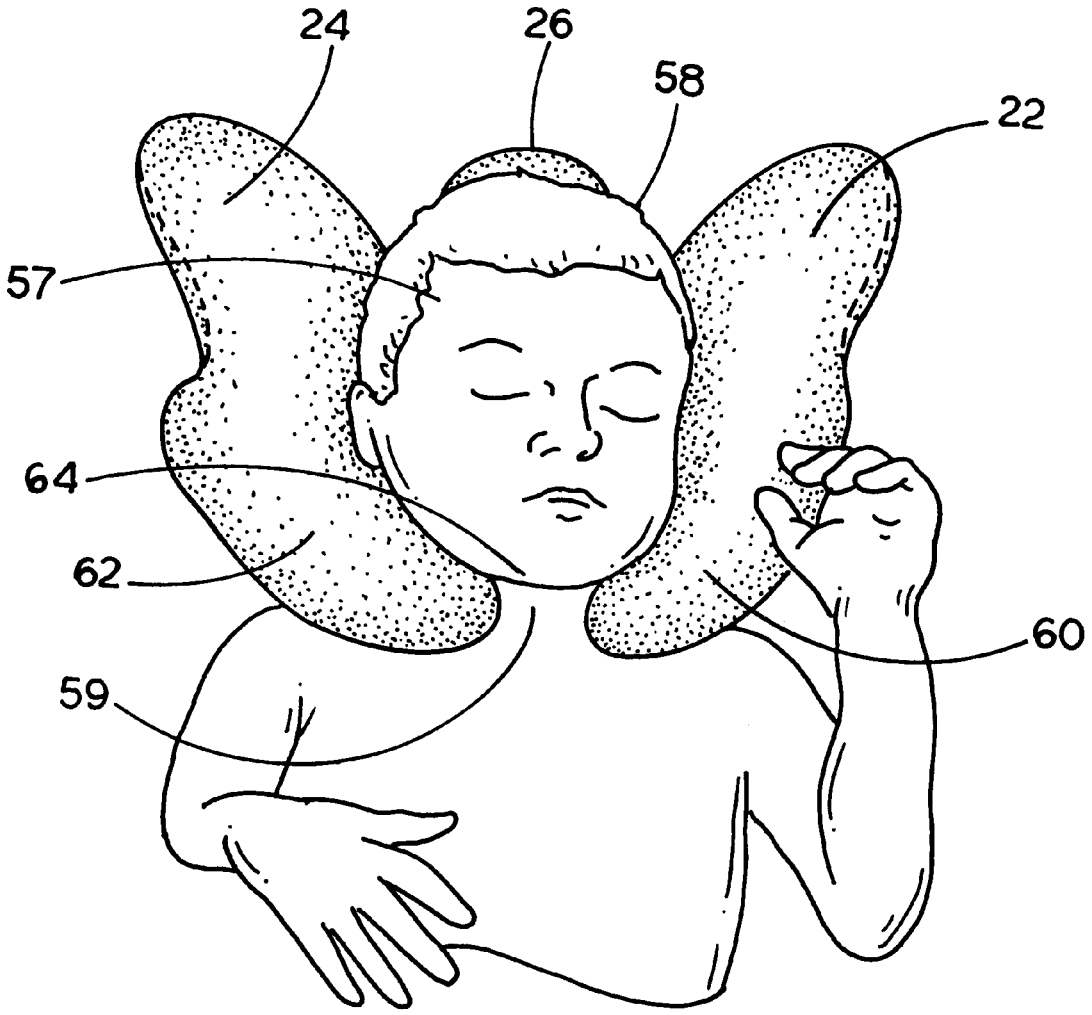
FIG. 13 is a top plan view of the pillow support illustrated in FIG. 1, supporting an older child.

Referring to FIG. 13, support pillow 10 can be used to provide support for the head 57 and neck 59 of older children 58 or adults. The first wing tip 60 of first wing section 22 and the second wing tip 62 of second wing section 24 are each positioned under the chin 64 of child 58 to restrict the movement of the head 57 of child 58. The head 57 of the child 58 is thereby maintained in a centered position on support pillow 10 and consequently is well supported on central section 16 and protruding portion 26 of the body 11 of support pillow 10.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A support pillow, comprising:

a body having a first end and a second end, including:

a central section having a flexible protruding portion at the first end of the body capable of being folded over to underlie and raise the first end of the body; and two wing sections pivotally attached to opposed sides of the central section, the wing sections being discrete from and larger than the central section, the wing sections being pivotally movable relative to the central section.

2. The support pillow as defined in claim 1, wherein the central section has a first side and a second side, a first wing section being pivotally secured to the first side and a second wing section being pivotally secured to the second side.

3. The support pillow as defined in claim 1, wherein the body has a first end and a second end, and the two wing sections extend past the central section at the second end to form a generally "U" shaped channel.

4. The support pillow as defined in claim 1, wherein the body has a first end and a second end, the central section decreasing in width from the first end to the second end.

5. The support pillow as defined in claim 1, wherein the body has a first end and a second end, and the central section is generally circular in cross section and decreases in circumference from the first end to the second end.

6. The support pillow as defined in claim 1, wherein the wing sections have outer peripheral edges with at least one indentation.

7. The support pillow as defined in claim 1, wherein the wing sections have more padding than the central section.

8. A support pillow, comprising:

a body having a first end and a second end and including:

a central section having a first side and a second side;

a first wing section pivotally secured to the first side of the central section; and a second wing section pivotally secured to the second side of the central section;

the first wing section and the second wing sections being discrete from and larger than the central section, the wing sections being pivotally movable relative to the central section;

a flexible protruding portion extending from the central section at the first end of the body capable of being folded over to underlie and raise the first end of the body;

the first wing section and the second wing section extending past the central section at the second end of the body to form a generally "U" shaped channel.

9. The support pillow as defined in claim 8, wherein the central section decreases in width from the first end to the second end of the body.

10. The support pillow as defined in claim 8, wherein the central section is generally circular in cross section decreasing in circumference from the first end to the second end of the body.

11. The support pillow as defined in claim 8, wherein the first wing section and the second wing section each have outer peripheral edges with at least one indentation.

* * * * *